US008915706B2

(12) United States Patent
Stein et al.

(10) Patent No.: US 8,915,706 B2
(45) Date of Patent: Dec. 23, 2014

(54) TRANSITION NOZZLE

(75) Inventors: Alexander Stein, Simpsonville, SC (US); Gunnar Leif Siden, Greenville, SC (US)

(73) Assignee: General Electric Company, Schenectady, NY (US)

( * ) Notice: Subject to any disclaimer, the term of this patent is extended or adjusted under 35 U.S.C. 154(b) by 650 days.

(21) Appl. No.: 13/275,966

(22) Filed: Oct. 18, 2011

(65) Prior Publication Data

US 2013/0094952 A1 Apr. 18, 2013

(51) Int. Cl.
*F01D 9/02* (2006.01)
*F01D 5/14* (2006.01)

(52) U.S. Cl.
CPC ..... *F01D 9/023* (2013.01); *F01D 5/145* (2013.01)
USPC ..... 415/202; 60/39.37

(58) Field of Classification Search
CPC ..... F01D 5/145; F01D 9/023; F01D 9/02; F01D 9/048
USPC ..... 60/39.37, 752, 755, 804, 805; 415/202, 415/203, 206, 208.1
See application file for complete search history.

(56) References Cited

U.S. PATENT DOCUMENTS

| | | | | |
|---|---|---|---|---|
| 2,743,579 | A * | 5/1956 | Gaubatz | 60/804 |
| 3,316,714 | A * | 5/1967 | Smith et al. | 60/752 |
| 5,397,215 | A | 3/1995 | Spear et al. | |
| 5,466,123 | A | 11/1995 | Rose | |
| 6,283,713 | B1 | 9/2001 | Harvey et al. | |
| 6,669,445 | B2 | 12/2003 | Staubach et al. | |
| 7,179,049 | B2 | 2/2007 | Glasspoole | |
| 7,465,155 | B2 * | 12/2008 | Nguyen | 415/210.1 |
| 7,887,297 | B2 | 2/2011 | Allen-Bradley et al. | |
| 7,930,891 | B1 * | 4/2011 | Brostmeyer | 60/752 |
| 8,113,003 | B2 * | 2/2012 | Charron et al. | 60/752 |
| 2007/0258819 | A1 | 11/2007 | Allen-Bradley et al. | |
| 2008/0267772 | A1 | 10/2008 | Harvey et al. | |
| 2009/0133377 | A1 | 5/2009 | Kenyon et al. | |
| 2009/0266047 | A1 | 10/2009 | Kenyon et al. | |
| 2010/0037618 | A1 * | 2/2010 | Charron et al. | 60/752 |
| 2010/0077762 | A1 | 4/2010 | Hessler et al. | |
| 2010/0115953 | A1 * | 5/2010 | Davis et al. | 60/752 |
| 2010/0284818 | A1 | 11/2010 | Sakamoto et al. | |

* cited by examiner

*Primary Examiner* — J. Gregory Pickett
(74) *Attorney, Agent, or Firm* — Cantor Colburn LLP

(57) ABSTRACT

A transition nozzle is provided and includes a liner in which combustion occurs and through which products of the combustion flow toward a turbine bucket stage. The liner includes opposing endwalls and opposing sidewalls extending between the opposing endwalls. The opposing sidewalls are oriented to tangentially direct the flow of the combustion products toward the turbine bucket stage. At least one of the opposing endwalls and the opposing sidewalls including a flow contouring feature to guide the flow of the combustion products.

20 Claims, 2 Drawing Sheets

TRANSITION NOZZLE

BACKGROUND OF THE INVENTION

The subject matter disclosed herein relates to a transition nozzle and, more particularly, a transition nozzle having non-axisymetric endwall contouring.

Typical gas turbine engines include a compressor, a combustor and a turbine. The compressor compresses inlet gas and includes and outlet. The combustor is coupled to the outlet of the compressor and is thereby receptive of the compressed inlet gas. The combustor then mixes the compressed gas with combustible materials, such as fuel, and combusts the mixture to produce high energy and high temperature fluids. These high energy and temperature fluids are directed to a turbine for power and electricity generation.

Generally, the combustor and the turbine would be aligned with the engine centerline. A first stage of the turbine would thus be provided as a nozzle (i.e., the stage 1 nozzle) having airfoils that are oriented and configured to direct the flow of the high energy and high temperature fluids tangentially so that the tangentially directed fluids aerodynamically interact with and induce rotation of the first bucket stage of the turbine.

With such construction, the first turbine stages exhibit strong secondary flows in which the high energy and high temperature fluids flow in a direction transverse to the main flow direction. That is, if the main flow direction is presumed to be axial, the secondary flows propagate circumferentially or radially. This can negatively impact the stage efficiency and has led to development of non-axisymetric endwall contouring (EWC), which has been effective in reducing secondary flow losses for turbines. Current EWC is, however, only geared toward conventional vanes and blades with leading and trailing edges.

BRIEF DESCRIPTION OF THE INVENTION

According to one aspect of the invention, a transition nozzle is provided and includes a liner in which combustion occurs and through which products of the combustion flow toward a turbine bucket stage. The liner includes opposing endwalls and opposing sidewalls extending between the opposing endwalls. The opposing sidewalls are oriented to tangentially direct the flow of the combustion products toward the turbine bucket stage. At least one of the opposing endwalls and the opposing sidewalls includes a flow contouring feature to guide the flow of the combustion products.

According to another aspect of the invention, a transition nozzle is provided and includes a liner having a first section in which combustion occurs and a second section downstream from the first section through which products of the combustion flow toward a turbine bucket stage. The liner includes, at the second section, opposing endwalls and opposing sidewalls extending between the opposing endwalls. The opposing sidewalls are oriented to tangentially direct the flow of the combustion products toward the turbine bucket stage. At least one of the opposing endwalls and the opposing sidewalls includes a non-axisymetric flow contouring feature to guide the flow of the combustion products.

According to yet another aspect of the invention, a gas turbine engine is provided and includes a compressor having an outlet through which compressed flow passes, a combustor stage coupled to the outlet, the combustor stage being receptive of the compressed flow and including a combustor in which combustible materials are mixed and combusted with the compressed flow to produce exhaust and a turbine coupled to the combustor stage, which is receptive of the exhaust produced in the combustor for power generation. A portion of the combustor being oriented tangentially with respect to an engine centerline and includes a non-axisymetric flow guiding feature.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
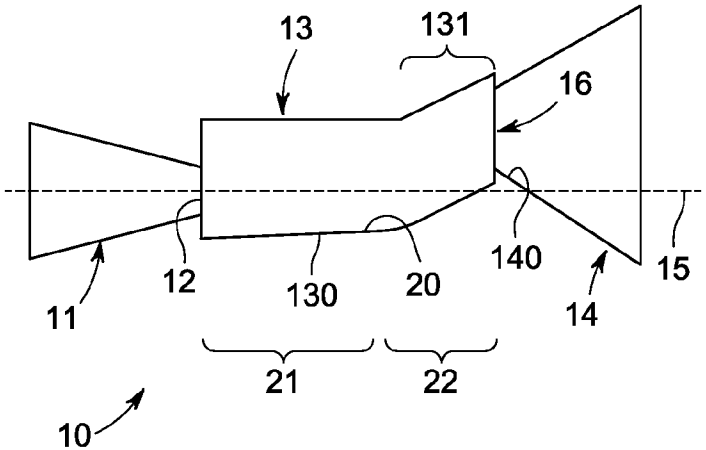
FIG. 1 is a schematic view of a gas turbine engine.
Figure 2:
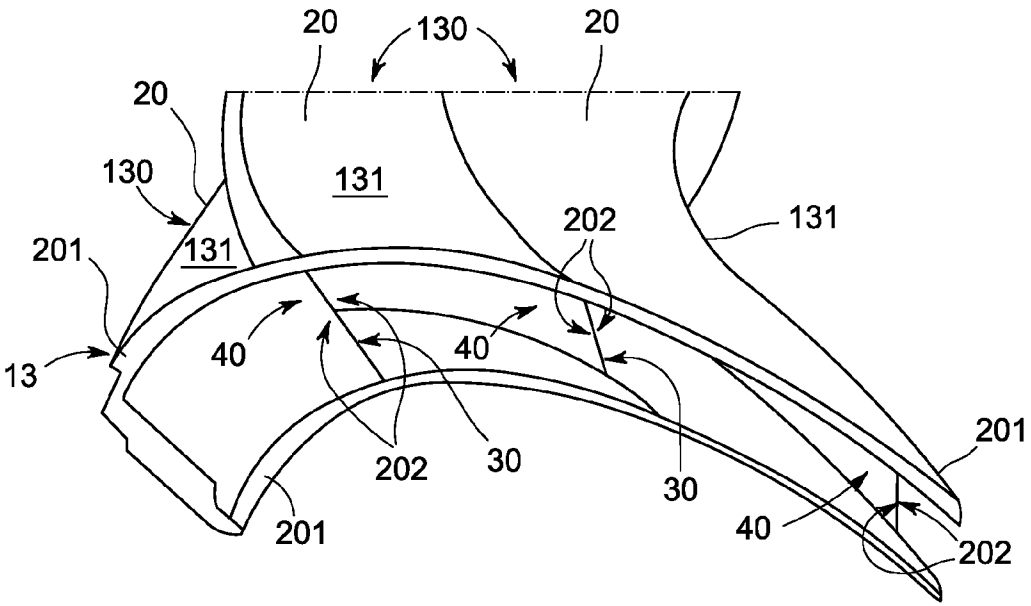
FIG. 2 is a perspective view of a portion of the gas turbine engine of FIG. 1.

With reference to FIGS. 1 and 2, a gas turbine engine 10 is provided and includes a compressor 11 having an outlet 12 through which compressed flow passes, a combustor stage 13 coupled to the outlet 12 and a turbine 14. The combustor stage 13 is receptive of the compressed flow via the outlet 12 and includes a combustor 130 in an interior of which combustible materials are mixed and combusted with the compressed flow output from the compressor 11 to produce exhaust. The turbine 14 is coupled to the combustor stage 13 and is receptive of the exhaust produced in the combustor 130 for power and/or electricity generation. A portion 131 of the combustor 130 is oriented tangentially with respect to an engine centerline 15 and includes a non-axisymetric flow contouring feature 16.

In a typical gas turbine engine, the combustor would be aligned with the engine centerline and a first stage of the turbine would be provided as a nozzle (i.e., the stage 1 nozzle) having airfoils that are oriented and configured to direct the flow of the combustion products tangentially so that the tangentially directed combustion products induce rotation of the first bucket stage of the turbine. As described herein, however, the stage 1 nozzle can be integrated with the combustor 130 such that at least the portion 131 of the combustor 130 serves as the stage 1 nozzle. That is, with the portion 131 of the combustor 130 being disposed adjacent to the first turbine bucket stage 140 of the turbine 14, the tangential orientation of the portion 131 of the combustor 130 with respect to the engine centerline 15 directs the flow of the combustion products tangentially toward the first turbine bucket stage 140. This induces the necessary rotation of the first turbine bucket stage 140 and the turbine 14 need not include a first nozzle stage.

The combustor stage 13 may include a plurality of combustors 130 in an annular or can-annular array. Each of the plurality of the combustors 130 includes a respective portion 131 that is oriented tangentially with respect to the engine centerline 15. In addition, each of the respective portions 131 includes a non-axisymetric flow contouring feature 16. In accordance with embodiments, the tangential orientations and non-axisymetric flow contouring features 16 of each portion 131 of each combustor 130 may be respectively unique or respectively substantially similar.

Still referring to FIGS. 1 and 2, each of the combustors 130 includes a liner 20. The liner 20 forms a first or forward section 21 and a second or aft section 22. The forward section 21 has an annular shape and defines an interior in which combustion of the compressed flow and the combustible materials occurs. The aft section 22 is fluidly coupled to the forward section 21 and defines a pathway through which the products of the combustion flow toward the first turbine bucket stage 140. Along an interface of the forward section 21 and the aft section 22, a shape of the liner 20 changes such that, at the aft section 22, the liner 20 includes opposing endwalls 201 and opposing sidewalls 202. The opposing sidewalls 202 extend between the opposing endwalls 201 forming an interior at the aft section 22 with a non-round and/or irregular cross-sectional shape. Since the opposing endwalls 201 and the opposing sidewalls 202 are formed as extensions of the liner 20 at the forward section 21 and lead to the first turbine bucket stage 140, the opposing endwalls 201 and the opposing sidewalls 202 both lack leading edges while the opposing endwalls 201 may also lack trailing edges.

The portion 131 of the combustor 130 that is oriented tangentially with respect to the engine centerline 15 is generally disposed within the aft section 22. In accordance with embodiments, the tangential orientation is provided by the opposing sidewalls 202 being angled or curved in the circumferential dimension about the engine centerline 15. Thus, one of the opposing sidewalls 202 is concave and the other is convex, the concave one of the opposing sidewalls 202 representing a pressure side 30 and the convex one of the opposing sidewalls 202 representing a suction side 40.

Figure 3:
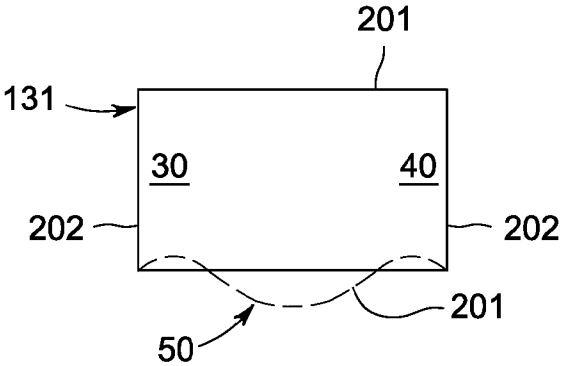
FIG. 3 is an axial view of a flow contouring feature in accordance with embodiments.

With reference to FIG. 3, the non-axisymetric flow contouring feature 16 (see FIG. 1) may include a trough 50 defined in at least one of the opposing endwalls 201 and/or at least one of the opposing sidewalls 202. In accordance with embodiments, the trough 50 may be defined as a depression in the lower one of the opposing endwalls 201 and may be positioned proximate to or within the pressure side 30.

Figure 4:
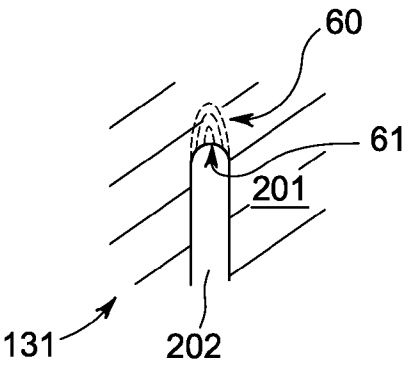
FIG. 4 is a radial topographical view of a flow contouring feature in accordance with embodiments.

With reference to the topography of FIG. 4, the non-axisymetric flow contouring feature 16 may include a trailing edge ridge 60 defined in at least one of the opposing endwalls 201 and/or at least one of the opposing sidewalls 202. In accordance with embodiments, the trailing edge ridge 60 may be defined as a ridge running radially along a trailing edge 61 of one or both of the opposing sidewalls 202.

Figure 5:
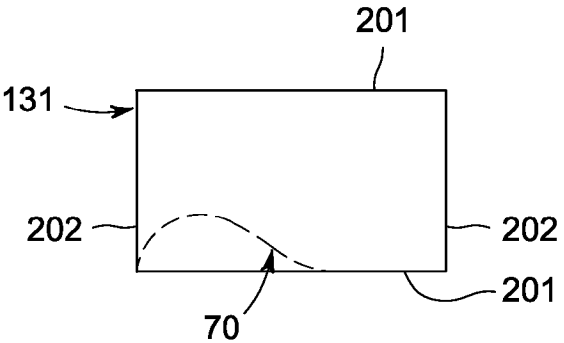
FIG. 5 is an axial view of a flow contouring feature in accordance with embodiments.

With reference to FIG. 5, the non-axisymetric flow contouring feature 16 may include a protrusion 70 defined in at least one of the opposing endwalls 201 and/or at least one of the opposing sidewalls 202. In accordance with embodiments, the protrusion 70 may be defined as an aerodynamic protrusion protruding from at least one of the opposing endwalls 201 and/or at least one of the opposing sidewalls 202.

Figure 6:
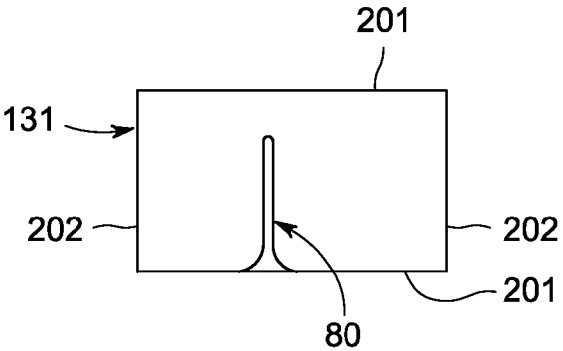
FIG. 6 is an axial view of a flow contouring feature in accordance with embodiments.

With reference to FIG. 6, the non-axisymetric flow contouring feature 16 may include a fence 80 disposed between the opposing endwalls 201 and/or the opposing sidewalls 202. In accordance with embodiments, the fence 80 may be formed as a planar member extending outwardly from the lower one of the opposing endwalls 201 with a profile that may or may not mimic those of the opposing sidewalls 202.

The embodiments described herein are merely exemplary and do not represent an exhaustive listing of the various configurations and arrangements of the portion 131 of the combustor 130 or the non-axisymetric flow contouring feature 16.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A transition nozzle, comprising:

a liner in which combustion occurs and through which products of the combustion flow toward a turbine bucket stage, the liner including opposing endwalls and opposing sidewalls extending between the opposing endwalls, the opposing sidewalls being oriented to tangentially direct the flow of the combustion products toward the turbine bucket stage, and at least one of the opposing endwalls and the opposing sidewalls including a flow contouring feature extending partially along a longitudinal length of the sidewalls to guide the flow of the combustion products, the flow contouring feature having a mid-section that is non-reflectively shaped relative to a corresponding mid-section of the at least one of the opposing endwall or sidewall that does not include the flow contouring feature.

2. The transition nozzle according to claim 1, wherein the flow contouring feature comprises a trough formed in the mid-section of the flow contouring feature between opposite peaks respectively terminating along their respective outer downslopes.

3. The transition nozzle according to claim 1, wherein the flow contouring feature comprises a trailing edge ridge running radially along a portion of a trailing edge of one of the opposing sidewalls.

4. The transition nozzle according to claim 1, wherein the flow contouring feature comprises a semi-teardrop shaped protrusion.

5. The transition nozzle according to claim 1, wherein the flow contouring feature comprises an elongate fence with a curved base.

6. A transition nozzle, comprising:

a liner having a first section in which combustion occurs and a second section downstream from the first section through which products of the combustion flow toward a turbine bucket stage, the liner including, at the second section, opposing endwalls and opposing sidewalls extending between the opposing endwalls, the opposing sidewalls being oriented to tangentially direct the flow of the combustion products toward the turbine bucket stage, and at least one of the opposing endwalls and the opposing sidewalls including a non-axisymetric flow contouring feature extending partially along a longitudinal length of the sidewalls to guide the flow of the combustion products, the flow contouring feature having a mid-section that is non-reflectively shaped relative to a corresponding mid-section of the at least one of the opposing endwall or sidewall that does not include the flow contouring feature.

7. The transition nozzle according to claim 6, wherein the flow contouring feature comprises a trough formed in the mid-section of the flow contouring feature between opposite peaks respectively terminating along their respective outer downslopes.

8. The transition nozzle according to claim 6, wherein the flow contouring feature comprises a trailing edge ridge running radially along a portion of a trailing edge of one of the opposing sidewalls.

9. The transition nozzle according to claim 6, wherein the flow contouring feature comprises a semi-teardrop shaped protrusion.

10. The transition nozzle according to claim 6, wherein the flow contouring feature comprises an elongate fence with a curved base.

11. A gas turbine engine, comprising:

a compressor having an outlet through which compressed flow passes;

a combustor stage coupled to the outlet, the combustor stage being receptive of the compressed flow and including a combustor in which combustible materials are mixed and combusted with the compressed flow to produce exhaust; and a turbine coupled to the combustor stage, which is receptive of the exhaust produced in the combustor for power generation, a portion of the combustor being oriented tangentially with respect to an engine centerline and including a non-axisymetric flow contouring feature, the flow contouring feature extending partially along a longitudinal length of sidewalls of the portion of the combustor and having a mid-section that is non-reflectively shaped relative to a corresponding mid-section of the at least one of the opposing endwall or sidewall that does not include the flow contouring feature.

12. The gas turbine engine according to claim 11, wherein the portion of the combustor serves as a stage 1 nozzle of the turbine.

13. The gas turbine engine according to claim 11, wherein the portion of the combustor is adjacent to a stage 1 bucket of the turbine.

14. The gas turbine engine according to claim 11, wherein the combustor stage includes a plurality of combustors in an annular array.

15. The gas turbine engine according to claim 14, wherein each of the plurality of the combustors comprises a portion oriented tangentially with respect to an engine centerline, the portion including a flow contouring feature.

16. The gas turbine engine according to claim 15, wherein the tangential orientations and flow contouring features of each portion are substantially similar.

17. The gas turbine engine according to claim 11, wherein the flow contouring feature comprises a trough formed in the mid-section of the flow contouring feature between opposite peaks respectively terminating along their respective outer downslopes.

18. The gas turbine engine according to claim 11, wherein the flow contouring feature comprises a trailing edge ridge running radially along a portion of a trailing edge of one of the sidewalls.

19. The gas turbine engine according to claim 11, wherein the flow contouring feature comprises a semi-teardrop shaped protrusion.

20. The gas turbine engine according to claim 11, wherein the flow contouring feature comprises an elongate fence with a curved base.

* * * * *